United States Patent [19]

Lusch et al.

[11] Patent Number: 4,526,588

[45] Date of Patent: Jul. 2, 1985

[54] PROCESS FOR THE PRODUCTION OF A COAL-WATER SUSPENSION WHICH IS SUITABLE FOR USE IN COAL GASIFICATION UNDER ELEVATED PRESSURE

[75] Inventors: Jurgen Lusch, Oberhausen; Heinrich Heinen, Ottobrunn; Bernhard Lieder, Bottrop; Volkmar Schmidt, Oberhausen; Wolfgang Kolodzey, Duisburg, all of Fed. Rep. of Germany

[73] Assignee: Ruhrchemie Aktiengesellschaft, Oberhausen, Fed. Rep. of Germany

[21] Appl. No.: 490,547

[22] Filed: May 6, 1983

Related U.S. Application Data

[63] Continuation of Ser. No. 238,883, Feb. 27, 1981, abandoned.

[30] Foreign Application Priority Data

Aug. 19, 1978 [DE] Fed. Rep. of Germany ..... 2836440

[51] Int. Cl.[3] ..... C10J 3/02

[52] U.S. Cl. ..... 48/202; 44/51; 48/DIG. 7

[58] Field of Search ..... 48/202, 206, DIG. 7; 252/310; 406/197; 44/51; 241/10, 21, 20, 24

[56] References Cited

U.S. PATENT DOCUMENTS

| | | | |
|---|---|---|---|
| 1,577,052 | 3/1926 | Auspitzer | 241/21 |
| 2,346,151 | 4/1944 | Burk | 241/20 |
| 2,373,635 | 4/1945 | Wuensch | 241/20 |
| 3,073,652 | 7/1963 | Reichl | 302/197 |
| 3,261,559 | 7/1966 | Yavorsky et al. | 241/24 |
| 3,762,887 | 10/1973 | Clancey et al. | 44/51 |
| 3,854,666 | 12/1974 | Switzer | 241/24 |
| 3,908,912 | 9/1975 | Irons et al. | 241/20 |
| 4,252,638 | 2/1981 | Bender et al. | 241/24 |

OTHER PUBLICATIONS

Perry, "Chemical Engineers' Handbook", 4th Edition, pp. 8-10, 8-39-8-42, 1963.

*Primary Examiner*—Peter Kratz

*Attorney, Agent, or Firm*—Sprung Horn Kramer & Woods

[57] ABSTRACT

A coal-water suspension containing 50 to 75 percent by weight coal, based on the weight of the suspension, the bulk of the coal having a particle size of 50 to 500 μm, the proportion of the particles having a diameter greater than 0.5 mm in the coal being less than 15 percent by weight and the particle size distribution curve of the coal in the Rosin-Rammler particle size distribution grid according to DIN 4190 having a slope of ≧1; a process for the production of such water-coal suspension which is suitable for use in coal gasification under elevated pressure by mixing lump coal with water directly, the water being added in a concentration just sufficient to form a water-coal dust suspension suitable for the gasification reaction and grinding the resultant suspension in a disc attrition mill, a toothed disc attrition mill or a toothed colloid mill.

11 Claims, 1 Drawing Figure

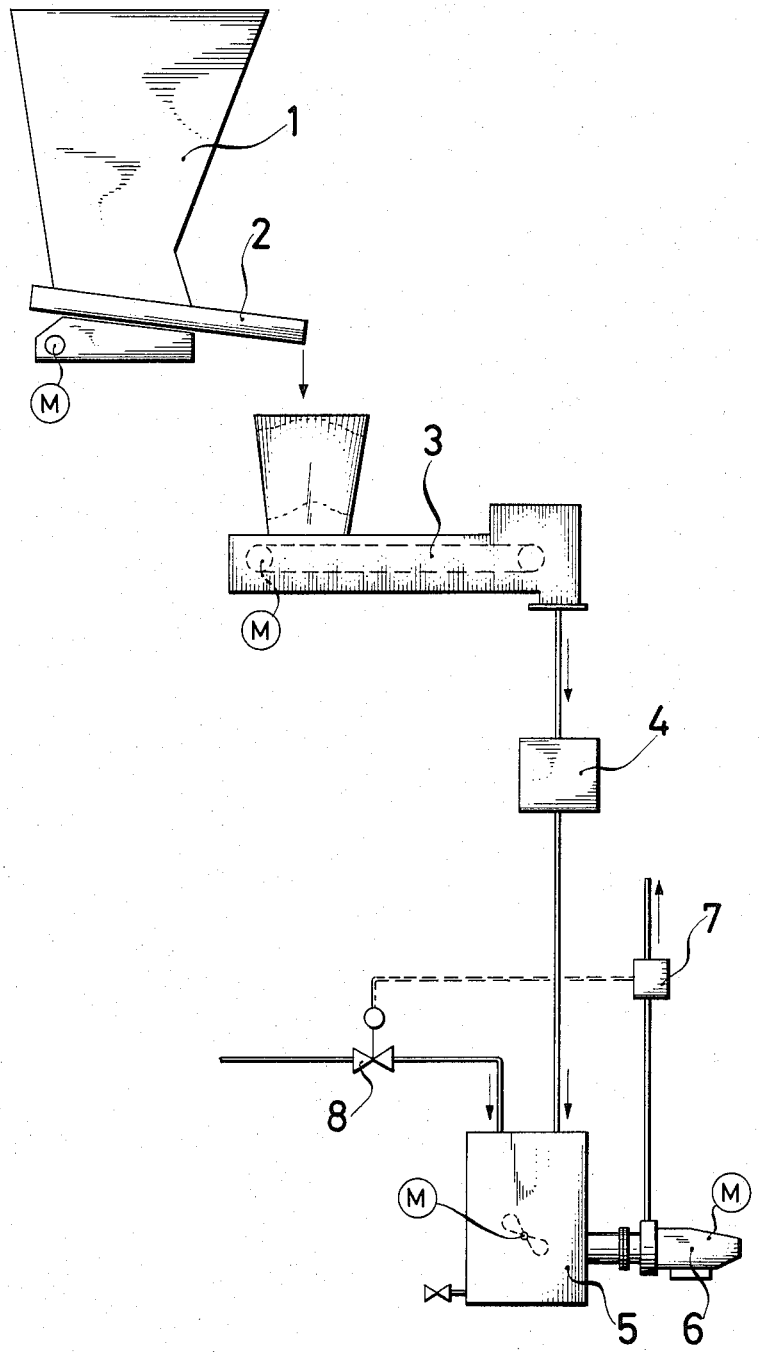
1
2
M
3
M
4
7
8
M
M
5
6

PROCESS FOR THE PRODUCTION OF A COAL-WATER SUSPENSION WHICH IS SUITABLE FOR USE IN COAL GASIFICATION UNDER ELEVATED PRESSURE

This application is a continuation of application Ser. No. 238,883 filed Feb. 27, 1981 now abandoned.

BACKGROUND OF THE INVENTION

1. Field of the Invention

This invention relates to the formation of a coal-water suspension containing 50 to 75 percent by weight coal based on the weight of the suspension, the bulk of the coal having a particle size of 50 to 500 μm, the proportion of particles having a diameter greater than 0.5 mm in the coal being less than 15 percent by weight and the particle size distribution curve of the coal in the Rosein-Rammler particle size distribution grid according to Deutsche IndustrieNorm 4190 having a slope of $>1$. This invention also relates a process for the production of such coal-water suspension by mixing lump coal with water at the final concentration required for a water-coal dust suspension for the gasification reaction and thereafter grinding the resultant suspension in a disc attrition mill, a toothed disc attrition mill or a toothed colloid mill.

DISCUSSION OF THE PRIOR ART

It is known to produce $CO:H_2$ mixtures from lumpy carbonaceous fuels such as bituminous coal, brown coal or lignite by partial combustion with oxygen-containing gas in the presence of steam. Such a process is described, for example, in German Pat. No. 2,044,310. In this process, the fuel is initially ground, then slurried in water, and the slurry is supplied to the reactor by means of a pump under pressure.

The mixture of solid and water must comply with two conditions: it must be pumpable but should, if possible, contain only sufficient water as is necessary for the gasification reaction to achieve a high cold gas efficiency which is defined as the ratio of the calorific value of the gas, based on the calorific value of coal. Generally, the amount of water necessary for tar gasification is 25 to 50 weight precent based upon the combined weight of the water and coal.

It is also known to grind coal in dry mills after previous drying (if evolution of gas is likely to occur, under protective gas) to the fineness desired. In many cases, the grinding machine is equipped with a classifier, e.g., a sifter, to set an upper limit to the particle size. The ground material thus obtained is extremely difficult to suspend in water due to its hydrophobic properties. Therefore, the production of the suspension requires expensive mixing apparatus, the addition of wetting agents and generally the use of excess amounts of water (based on the water required in the gasification reaction) to achieve suspension at all. Therefore, the excess water must be separated by means of expensive separators.

In addition, several dry grinding machines which are widely used such as ball mills or vibration mills have the great disadvantage that they furnish an excessively broad range of particle sizes so that the limit of pumpability is achieved at relatively low solids contents due to a high proportion of ultrafine particles.

Wet grinding of coal in a tube mill is described in German (BRD) Pat. No. 1,526,174. Since the proportion of water in the grinding procedure must be relatively high in this process, i.e., 50 to 65 percent by weight, partial dehydration of the suspension in the machine used for grinding and/or conveying of the suspension is necessary. Further disadvantages of this mode of operation include the susceptibility to troubles during dehydration which is effected through sieve assemblies, the high cost of the tube mill and the high intensity of noise produced by this mill.

It is an object of this invention, therefore, to provide a process which permits wet grinding of the coal directly at the coal/water ratio which is needed for the finished suspension so that no classifying, filtering or thickening apparatus at all are required. The particle size distribution of the ground coal should be narrow, and the operation of the grinding machine should be as simple and inexpensive as is possible and noiseless.

SUMMARY OF THE INVENTION

This invention resides in a process for the production of a coal-water suspension which is suitable for use in coal gasification under elevated pressure. The process is characterized in that the lump coal is mixed with water directly to the concentration needed by the water-coal dust suspension for the gasification reaction and subsequently ground in a disc attrition mill, toothed disc attrition mill or toothed colloid mill. Lump coal is understood to be crude coal as obtained directly in mining.

While coal and water may be mixed directly in the mill by supplying the water, for example, through a central bore of the feed screw shaft, it is more advantageous to mix coal and water upstream of the mill. The attrition disc mill has as grinding elements two grinding discs provided with a plurality of round impact pins the pin rows of which mesh with one another. Each two successive pin rows, moved relatively to each other, of the rotor and stator disc, respectively, form a grinding zone. The relative velocity of the pins increases from grinding zone to grinding zone thus compensating the tendency to break of the material being ground, said tendency decreasing as the comminution progresses. See Ullrich "Mechanische Verfahrenstechnik", Springer-Verlag, Berlin-Heidelberg-New York, 1967, the disclosure of which is hereby incorporated herein specifically by reference.

In the toothed disc attrition mill, the grinding elements are a stationary and a rotating toothed disc, the teeth of which are arranged along concentrical circles and mesh with little clearance (adjustable by axial displacement of a disc). The axially fed material to be ground passes through the pair of discs from the inside to the outside.

The toothed colloid mill is provided with toothed grinding elements having a grinding slot. In the slot, the teeth produce intensive liquid vortices in which the material being ground is comminuted. See Ullirch "Mechanische Verfahrenstechnik", supra.

Surprisingly, a fineness and narrow particle size distribution of the ground coal which are not achievable when grinding coal in known manner with ball or tube mills without classification are accomplished with the disc attrition mills, toothed colloid mills and toothed disc attrition mills used according to the invention. Since grinding is effected directly at the final concentration of the coal-water suspension, the previously necessary separatory and thickening equipment can be completely dispensed with.

It is achieved with the grinding machines mentioned above that the ground coal has a narrow particle size range so that, when represented in the Rosin-Rammler particle size distribution grid (according to Deutsche Industrie Norm (DIN) No. 4190), a steep particle size distribution curve having a slope of ≧1 is obtained. The proportion of coarse grains (>0.5 mm.) remains below 15 percent (measured with the analytical screen 0.5 DIN No. 4188). The bulk of the ground particles ranges between 50 and 500 μm. Due to the uniformity of the particle size obtained by grinding, one can obtain satisfactory pumpability up to a solids content of the water-coal suspension of 75 percent so that high coal gas efficiencies can establish themselves in coal gasification.

The width of the gap between the grinding tools of the mills used according to the invention is adjustable. It has been found that the gap should be kept as narrow as possible to achieve a good grinding result and, moreover, to avoid rapid wear of the grinding tools. Due to wear of the grinding tools, the gap between the grinding tools must be readjusted regularly.

Due to open storage and open transportation of coal, it cannot be avoided that foreign matter such as metal particles or stones and concrete lumps are invariably contained in it. Since the grinding tolls of the disc attrition mills, toothed colloid mills and toothed disc attrition mills may be destroyed by such foreign matter, it is desirable to remove foreign objects from the coal prior to grinding.

Metal particles can be removed from the stream of coal by means of magnet separators as the coal is metered to the mills. However, separation of the foreign matter by means of a separatory vessel in which the foreign matter is collected in the sump due to its higher weight has been found to be particularly favorable.

Optimum mixing of coal and water can be achieved by mechanically mixing the water and the lump coal directly prior to grinding in a slurrying or mashing vessel. As compared with the usual supply of the coal to the mill by means of metering screws, this mode of operation permits surprisingly a virtually doubling of the throughput capacity of the mills. It has been found that one can effect simultaneously mashing and separation of foreign matter ideally in a stirred vessel with an established sump for the separation of solids.

BRIEF DESCRIPTION OF DRAWING

Referring to the annexed drawing, the same is a side elevation showing the manner in which the invention is preferably practiced.

DESCRIPTION OF SPECIFIC EMBODIMENT

A preferred embodiment of the process according to the invention is represented in FIG. 1.

Referring to the drawing, crude coal is supplied from a bin 1 with drawoff device 2 to a metering device 3. The latter feeds the coal through a metal separating device 4 into a stirred vessel 5 in the sump of which the foreign matter is separated. The well premixed material to be ground flows to a mill 6. The finished suspension runs over a densimeter 7 which, through a controlling valve, adds sufficient water that the solids content desired is obtained.

What is claimed is:

1. A process for the preparation of a coal water slurry suitable for gasification under pressure which comprises subjecting a mixture of 50 to 75% by weight coal and 25 to 50% by weight water to the action of a disc or toothed disc attrition mill or toothed colloid mill until the bulk of the coal has a particle size of 50 to 500 μm and until the coal particles which have a diameter larger than 0.5 mm accounts for less than 15% by weight based upon the amount of coal whereby the particle size distribution curve of the coal in the Rosin-Rammler particle size distribution grid according to DIN No. 4190 has a slope of ≧1, wherein thereafter coal gasification of the resultant composition is effected without changing the relative amount of coal or water in the slurry and wherein said process is performed without classifying, filtering or thickening the slurry.

2. A process according to claim 1 wherein foreign matter contained in the coal is removed by means of a magnetic separator.

3. A process according to claim 1 wherein foreign matter contained in the coal is removed by a mechanical separating vessel prior to grinding the coal.

4. A process according to claim 1 wherein the coal and water are mechanically mixed in a mashing vessel prior to being fed to a disc attrition mill, toothed disc attrition mill or toothed colloid mill.

5. A process according to claim 1 wherein the coal and water are mixed in a stirred vessel and foreign matter present therein is simultaneously separated in the sump of the stirred vessel.

6. A process according to claim 1 wherein the coal/-water slurry is ground in a disc attrition mill.

7. A process according to claim 1 wherein the coal/-water slurry is ground in a toothed disc attrition mill.

8. A process according to claim 1 wherein the coal/-water slurry is ground in a toothed colloid mill.

9. A process according to claim 1, wherein said slurry is pumped into a coal gasification zone.

10. A process according to claim 1, wherein said slurry is passed to a coal gasification zone without removal of water.

11. A process according to claim 1, wherein said coal is lump coal.

* * * * *